US010519702B2

(12) United States Patent
Longerich et al.

(10) Patent No.: US 10,519,702 B2
(45) Date of Patent: Dec. 31, 2019

(54) RELEASABLE BALL LOCK HINGE

(71) Applicant: Raytheon Company, Waltham, MA (US)

(72) Inventors: Gregory E. Longerich, Oro Valley, AZ (US); William Owens, Tucson, AZ (US); Richard J. Wright, Tucson, AZ (US); David C. Robillard, Tucson, AZ (US); Perry H. Frahm, Tucson, AZ (US); Emerald J. Adair, Vail, AZ (US)

(73) Assignee: Raytheon Company, Waltham, MA (US)

( * ) Notice: Subject to any disclaimer, the term of this patent is extended or adjusted under 35 U.S.C. 154(b) by 127 days.

(21) Appl. No.: 15/610,409

(22) Filed: May 31, 2017

(65) Prior Publication Data

US 2017/0268270 A1 Sep. 21, 2017

Related U.S. Application Data

(62) Division of application No. 13/676,919, filed on Nov. 14, 2012, now abandoned.

(51) Int. Cl.
*E05D 7/10* (2006.01)

(52) U.S. Cl.
CPC ..... *E05D 7/1016* (2013.01); *E05D 7/1005* (2013.01); *E05D 2007/1033* (2013.01); *Y10T 16/524* (2015.01)

(58) Field of Classification Search
CPC ..... Y10T 403/592
See application file for complete search history.

(56) References Cited

U.S. PATENT DOCUMENTS

| | | | | |
|---|---|---|---|---|
| 1,759,237 | A | 5/1930 | McClure | |
| 2,624,907 | A | 1/1953 | Graham | |
| 3,498,653 | A * | 3/1970 | McCreery | B23B 29/20 403/322.2 |
| 3,583,734 | A * | 6/1971 | Magi | B60R 1/0617 16/332 |
| 4,114,235 | A | 9/1978 | Remington | |
| 4,350,463 | A * | 9/1982 | Friedline | B23B 31/1071 279/2.12 |
| 4,682,560 | A | 7/1987 | Lieb et al. | |
| 5,412,842 | A | 5/1995 | Riblett | |
| 5,940,934 | A * | 8/1999 | Turner | E05D 7/1011 16/257 |
| 6,092,334 | A | 7/2000 | Kim | |
| 6,415,476 | B1 | 7/2002 | McCoy | |
| 6,591,453 | B2 | 7/2003 | Jenks | |
| 7,377,137 | B1 * | 5/2008 | Bednarz | E05B 63/121 403/322.2 |

(Continued)

*Primary Examiner* — Emily M Morgan

(57) ABSTRACT

A releasable ball lock hinge is disclosed. The releasable ball lock hinge includes a first body operable with a hinge ball and a release ball. Each ball can be movable within respective openings of the first body. The releasable ball lock hinge also includes a second body configured to rotatably interface and removably couple with the first body. The hinge ball releasably engages the second body. The second body has a release recess operable with the release ball to disengage the hinge ball and alternately couple and release the first body and the second body based on a relative position between the first body and the second body.

10 Claims, 5 Drawing Sheets

(56) References Cited

U.S. PATENT DOCUMENTS

| | | | | |
|---|---|---|---|---|
| 7,472,458 | B2 | 1/2009 | Oddsen, Jr. | |
| 8,584,318 | B1 * | 11/2013 | Tu | E05D 7/1016 16/262 |
| 2003/0051314 | A1 | 3/2003 | Jenks | |
| 2007/0039132 | A1 * | 2/2007 | Jung | H04M 1/0216 16/325 |
| 2008/0155782 | A1 | 7/2008 | Chang et al. | |
| 2010/0050377 | A1 | 3/2010 | Ritachka | |
| 2014/0375020 | A1 * | 12/2014 | Bowe | B60D 1/52 280/511 |

* cited by examiner

RELEASABLE BALL LOCK HINGE

RELATED APPLICATIONS

This application is a divisional of U.S. patent application Ser. No. 13/676,919, filed on Nov. 14, 2012, which is incorporated by reference herein in its entirety.

BACKGROUND

Intercept vehicles, such as warheads or missiles, utilize highly sensitive optics to discriminate targets. In order to maintain optics sensitivity, the optical sensors are sealed prior to use and uncovered at the beginning of a mission. Typically, optics covers are ejected with a forward or side motion, and the vehicle is re-orientated, prior to release of the cover, to direct the cover away from possible interference with the vehicle. In some cases, optics covers are ejected without any re-orientation of the vehicle with the hope of a clean separation.

BRIEF DESCRIPTION OF THE DRAWINGS

Features and advantages of the invention will be apparent from the detailed description which follows, taken in conjunction with the accompanying drawings, which together illustrate, by way of example, features of the invention; and, wherein.

Figure 1A:
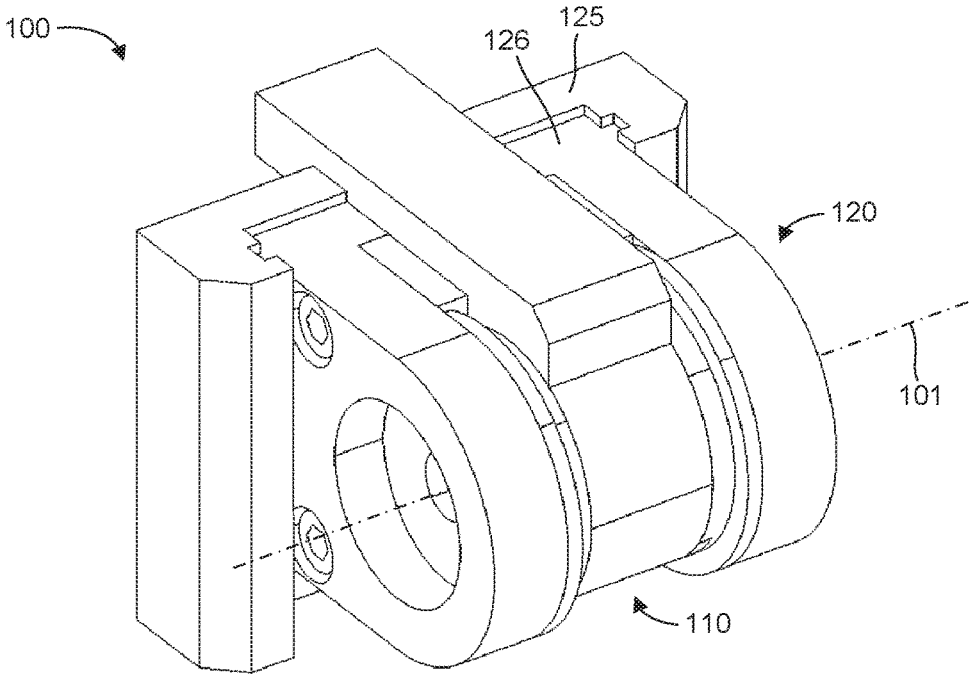
FIG. 1A is a top perspective view of a releasable ball lock hinge in accordance with an embodiment of the present invention.

Reference will now be made to the exemplary embodiments illustrated, and specific language will be used herein to describe the same. It will nevertheless be understood that no limitation of the scope of the invention is thereby intended.

DETAILED DESCRIPTION

As used herein, the term "substantially" refers to the complete or nearly complete extent or degree of an action, characteristic, property, state, structure, item, or result. For example, an object that is "substantially" enclosed would mean that the object is either completely enclosed or nearly completely enclosed. The exact allowable degree of deviation from absolute completeness may in some cases depend on the specific context. However, generally speaking the nearness of completion will be so as to have the same overall result as if absolute and total completion were obtained. The use of "substantially" is equally applicable when used in a negative connotation to refer to the complete or near complete lack of an action, characteristic, property, state, structure, item, or result.

As used herein, "adjacent" refers to the proximity of two structures or elements. Particularly, elements that are identified as being "adjacent" may be either abutting or connected. Such elements may also be near or close to each other without necessarily contacting each other. The exact degree of proximity may in some cases depend on the specific context.

An initial overview of technology embodiments is provided below and then specific technology embodiments are described in further detail later. This initial summary is intended to aid readers in understanding the technology more quickly but is not intended to identify key features or essential features of the technology nor is it intended to limit the scope of the claimed subject matter.

Current optical cover ejection techniques do not control the cover ejection angle and/or the direction of the cover's ejection path. The result is that covers are often ejected into the path of the vehicle or into the field of view of the optical sensors. Collision of the vehicle with the cover or an ejection path that puts the cover within the visible field of view can potentially jeopardized the mission. Re-orientation of the vehicle takes critical time away from the mission and expends precious energy from the propulsion system.

Accordingly, a releasable ball lock hinge is disclosed that facilitates separation of an optical cover to occur at a predetermined angular position. In one aspect, the separation angle can control the ejection path of the optical cover away from the vehicle. The releasable ball lock hinge can include a first body operable with a hinge ball and a release ball, each movable within respective openings of the first body. The releasable ball lock hinge can also include a second body configured to rotatably interface and removably couple with the first body. The hinge ball can releasably engage the second body. The second body can have a recess operable with the release ball to disengage the hinge ball and alternately couple and release the first body and the second body based on a relative position between the first body and the second body.

In one aspect, a releasable ball lock hinge is disclosed that can include a first body having first and second openings, first and second hinge balls configured to move within the first opening, first and second release balls configured to move within the second opening, and a second body configured to rotatably interface and removably couple with the first body. The second body can include hinge recesses to engage the first and second hinge balls when the first body and the second body are in a secured position, thereby providing an axis of rotation for the hinge. The second body can also include release recesses to receive the first and second release balls when the first body and the second body are in a release position. In the secured position, a portion of the second body can be configured to position the release balls such that the hinge balls are maintained in engagement with the hinge recesses. In the release position, the release recesses can facilitate movement of the release balls into the release recesses, and movement of the hinge balls out of engagement with the hinge recesses, thereby facilitating separation of the first body and the second body.

Figure 1B:
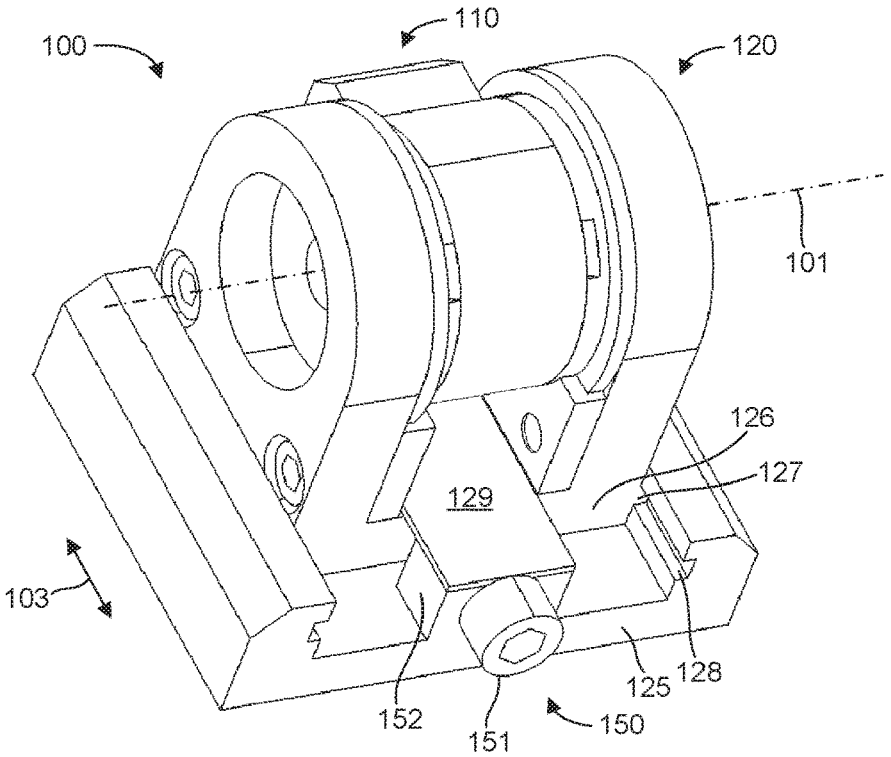
FIG. 1B is a bottom perspective view of the releasable ball lock hinge of FIG. 1A.

One embodiment of a releasable ball lock hinge 100 is illustrated in FIGS. 1A-1B. The releasable ball lock hinge 100 can comprise a first body 110 and a second body 120 that can be configured to rotatably interface and removably couple with the first body 110. The first body 110 and the second body 120 can be of any suitable configuration and the configurations shown illustrate example embodiments of the first and second bodies 110, 120. For example, the first and second bodies 110, 120 can form part of, or be coupled to, larger components that are not shown, such as a vehicle body and a cover for sensors supported by the vehicle body.

Figure 2A:
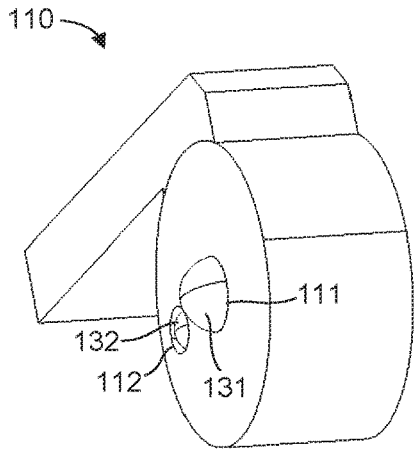
FIGS. 2A and 2B are perspective views of a first body of the releasable ball lock hinge of FIG. 1A.
Figure 2B:
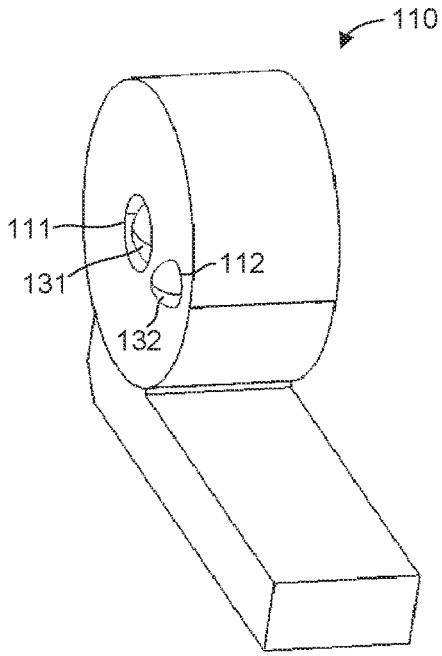
Figure 3:
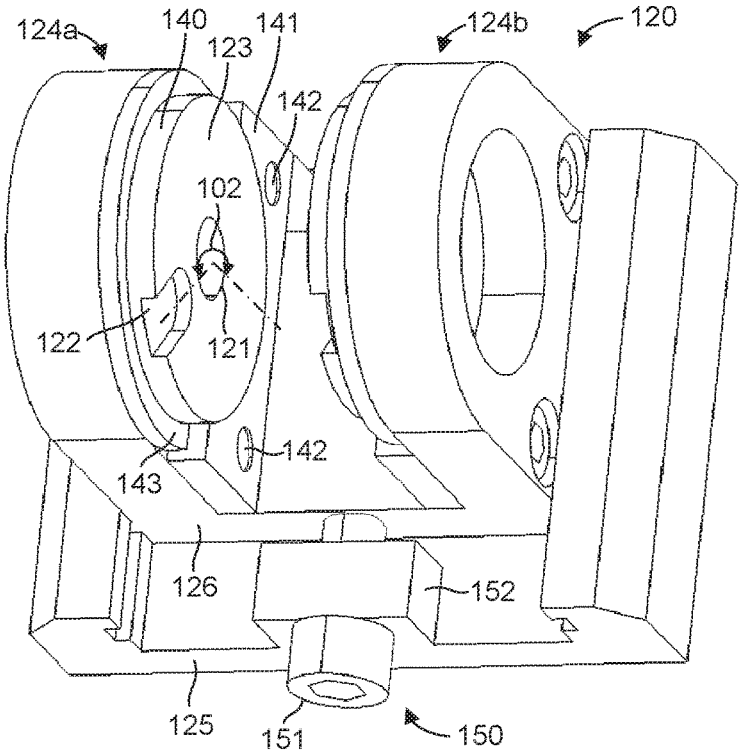
FIG. 3 is a perspective view of a second body of the releasable ball lock hinge of FIG. 1A.

For ease of reference, FIGS. 2A and 2B illustrate the first body 110 and FIG. 3 illustrates the second body 120 isolated from one another. The first body can be operable with a hinge ball 131 and a release ball 132. Each of the hinge ball 131 and the release ball 132 can be movable within respective openings 111, 112 of the first body 110. The hinge ball 131 can releasably engage the second body 120, such as a hinge recess 121 of the second body 120. The second body 120 can have a release recess 122, such as a detent, operable with the release ball 132 to disengage the hinge ball 131 from the hinge recess 121 and alternately couple and release the first body 110 and the second body 120 based on a relative position between the first body 110 and the second body 120. The hinge ball 131 can move within the opening 111 to alternately engage and disengage the hinge recess 121. The hinge recess 121 can engage the hinge ball 131 when the first body 110 and the second body 120 are in a secured position, thereby providing an axis of rotation 101 for the hinge 100. The release recess 122 can receive the release ball 132 when the first body 110 and the second body 120 are in a release position. A ball disclosed herein, such as a hinge ball or a release ball, can utilize standard ball bearing hardware, which are typically ground to precision tolerances and are inexpensive.

In the secured position, a portion 123 of the second body 120 can be configured to position the release ball 132 such that the hinge ball 131 is maintained in engagement with the hinge recess 121. For example, the portion 123 of the second body 120 can provide a surface for the release ball 132 to roll on and/or slide against as the first body 110 is rotated relative to the second body 120 in order to maintain the hinge ball 131 in engagement with the hinge recess 121 while in the secured position, which can include an angular range defined by a release angle 102. The first body 110 and the second body 120 can therefore be rotatable to facilitate contact between the release ball 132 and the portion 123 of the second body 120 to maintain engagement of the hinge ball 131 and the hinge recess 121 in the secured position. In the release position, the release recess 122 can facilitate movement of the release ball 132 into the release recess 122 and movement of the hinge ball 131 out of engagement with the hinge recess 121, thereby facilitating separation of the first body 110 and the second body 120. The first body 110 and the second body 120 can therefore be rotatable to align the release ball 132 with the release recess 122 which can facilitate separation of the first body 110 and the second body 120. A spring 129 can be included to apply a force to the first body 110 tending to separate the first body 110 from the second body 120. The spring 129 is discussed further hereinafter with respect to FIGS. 4A-4E.

In one aspect, the release angle 102 or, in other words, the angle of the release position of the first body 110 and the second body 120, can be variable and set to any suitable angle. This can be accomplished by moving or relocating the release recess 122. For example, the release recess 122 can be formed in a disk 140 that is movable to vary the angle 102 of the release position. A clamp 141 and fasteners 142 can be operable with a shoulder 143 of the disk 140 to facilitate variation of the angle 102 by rotating the release recess 122. Thus, one attribute of the releasable ball lock hinge 100 can include an adjustable release angle 102, which can facilitate separation of the first and second bodies 110, 120 to occur at a precise and predetermined angular opening. The release angle 102 can be set to any arbitrary value as needed for a given application. In one aspect, the release angle 102 can be greater than 180 degrees. This can allow for a significant amount of relative rotation between the first and second bodies 110, 120 prior to separation. In a highly dynamic situation with a high rate of relative rotation between the first and second bodies 110, 120, a large release angle 102 (i.e., greater than 180 degrees) can facilitate separation of the first and second bodies 110, 120 and direct one body away from the other.

As shown, the second body 120 can include supports 124*a*, 124*b* for the first body 110. Although the hinge ball 131 and the release ball 132 on one side of the first body 110 have been shown and described, it should be recognized that a hinge ball and a release ball can be operable with the first body 110 on an opposite side shown. Thus, in one aspect, one or both of the supports 124*a*, 124*b* can have formed therein a hinge recess and a release recess. The supports 124*a*, 124*b* can include features to facilitate variation of the angle 102 by rotating the release recess, such as a disk and clamp discussed above.

In one aspect, the second body can include a base component 125 and a carriage 126 movable relative to the base component 125 to adjust a position of the axis of rotation 101. The carriage 126 can be configured to translate with respect to the base component 125 in direction 103. For example, the carriage 126 can include a tongue 127 configured to slide within a groove 128 of the base component 125. In addition, the relative movement and position of the carriage 126 and the base component 125 can be controlled or achieved by an adjustment mechanism 150. The spring 129 of FIG. 1B has been omitted in FIG. 3 to further reveal the adjustment mechanism 150. The adjustment mechanism 150 can include a screw 151 supported by a tab 152 of the base component 125. The screw 151 can be configured to cause movement of the carriage 126 relative to the base component 125 when rotated, which can adjust the position of the axis of rotation 101. In other words, the adjustment mechanism can adjust the relative position between the first body 110 and the base component 125 of the second body 120. Such adjustment can be useful to account or compensate for a tolerance stack-up or a misalignment involving the releasable ball lock hinge 100. For example, this adjustment can facilitate proper seating of two components coupled to first and second bodies of the hinge 100, such as an optics cover coupled to the first body and a vehicle body supporting optical sensors coupled to the base component 125 of the second body 120 in order to provide proper sealing between the optics cover and the vehicle body. It should be recognized that the carriage 126 and the base component 125 can be of any suitable configuration to facilitate relative motion between one another. It should be further recognized that the adjustment mechanism 150 can be of any suitable configuration to cause relative motion between the carriage 126 and the base component 125 and/or to fix a position of the carriage 126 and the base component 125 to prevent unwanted relative motion.

Figure 4A:
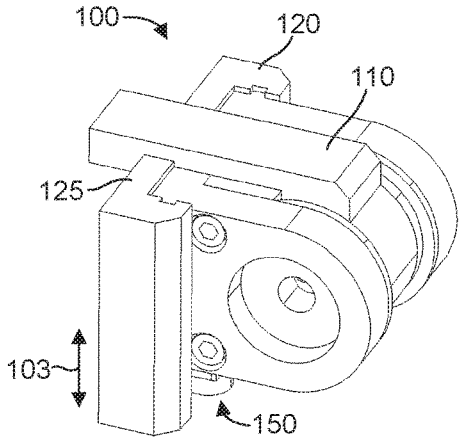
FIG. 4A-4E are example illustrations of the releasable ball lock hinge of FIG. 1A in use, in accordance with an embodiment of the present invention.
Figure 4B:
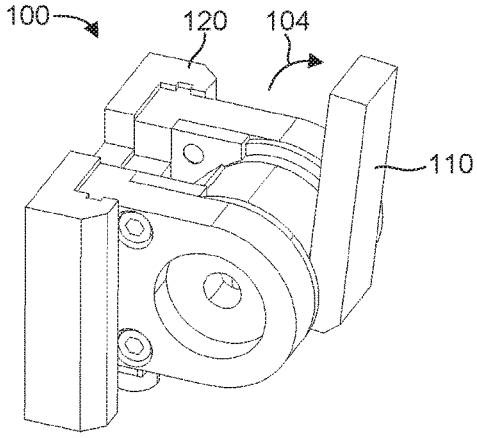
Figure 4C:
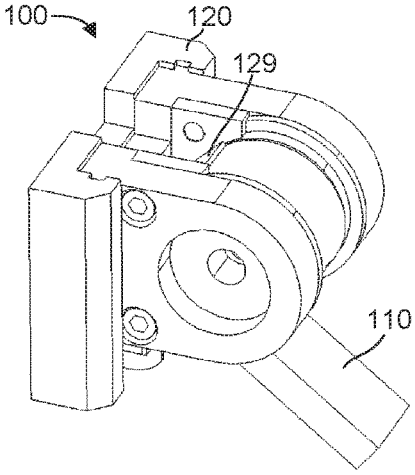
Figure 4D:
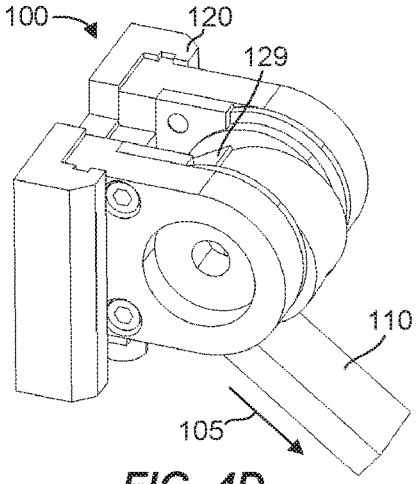
Figure 4E:
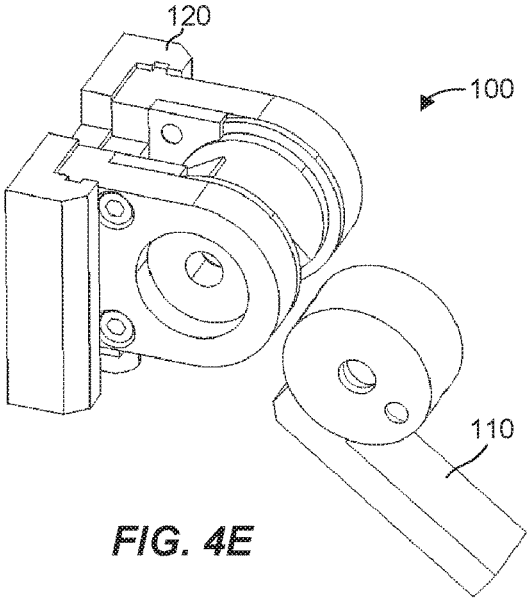

FIGS. 4A-4E illustrate the releasable ball lock hinge 100 in use to separate the first body 110 from the second body 120. FIG. 4A shows the first body 110 coupled to the second body 120 in the secured position. The adjustment mechanism 150 can be used as desired to adjust the position of the first body 110 relative to the base component 125 of the second body 120 in direction 103. The first body 110 can be rotated relative to the second body 120 in direction 104 while in the secured position and without separation of the first and second bodies 110, 120, as shown in FIG. 4B. Upon reaching the release position, shown in FIG. 4C, the first body 110 can begin to separate from the second body 120 in direction 105, as shown in FIG. 4D. Separation can continue until complete separation has occurred, as shown in FIG. 4E. It should be recognized that substantially the reverse process shown and described in FIGS. 4A-4E can be used to assemble the first and second bodies 110, 120. For example, the first and second bodies 110, 120 can be brought to the release position and rotated relative to one another to the secured position to couple the first and second bodies 110, 120. Thus, the releasable ball lock hinge 100 can be simple to assemble and to separate.

The spring 129 can apply a force to the first body 110 tending to separate the first body 110 from the second body 120. In one aspect, the spring can be configured to direct at least some force in a direction parallel to direction 105 to assist in separation the first body 110 from the second body 120. In another aspect, the spring 129 can be preloaded in contact with the first body 110, such that the first body 110 is forced away from the second body 120 upon reaching the release position. Although a cantilever spring is shown, the spring 129 can be of any suitable configuration, such as a coil spring or a torsion spring. It should be recognized that separation of the first body 110 and the second body 120 can occur without a spring force, as momentum from the rotating first body 110 can cause separation of the first and second bodies 110, 120 upon reaching the release position. The spring 129 can, however, be incorporated to facilitate or assist separation by providing a separation force.

Figure 5A:
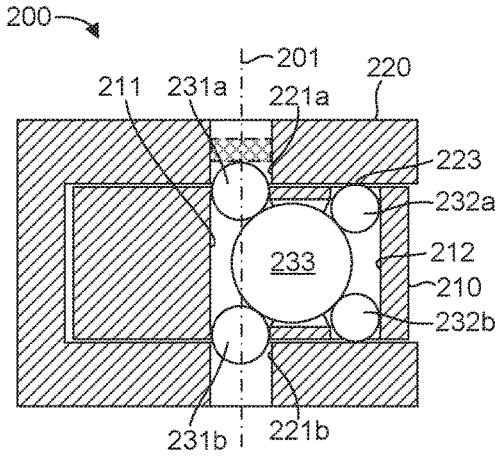
FIG. 5A-5E are cross-sectional views of a releasable ball lock hinge showing inner workings of the hinge in use, in accordance with another embodiment of the present invention.

FIGS. 5A-5E illustrate cross-sectional views of a releasable ball lock hinge 200 to show inner workings of the hinge 200 in use. The releasable ball lock hinge 200 is similar to the hinge 100 shown and described herein in many respects. For example, the hinge 200 can include a first body 210 having openings 211, 212. Hinge balls 231*a*, 231*b* can be configured to move within the opening 211 and release balls 232*a*, 232*b* can be configured to move within the opening 212. The hinge 200 can also include a second body 220 configured to rotatably interface and removably couple with the first body 210. The second body 220 can have hinge recesses 221*a*, 221*b* to engage the hinge balls 231*a*, 231*b* when the first body 210 and the second body 220 are in a secured position, thereby providing an axis of rotation 201 for the hinge 200, as shown in FIG. 5A. In the secured position, a portion 223 of the second body 220 can be configured to position the release balls 232*a*, 232*b* such that the hinge balls 231*a*, 231*b* are maintained in engagement with the hinge recesses 221*a*, 221*b*. The hinge recesses can comprise a "through hole" or a "blind hole." As disclosed herein, several balls can be incorporated in the design of the hinge 200, with one set 231*a*, 231*b* providing the axis of rotation 201 for the hinge 200 and another set 232*a*, 232*b* acting as a release for the hinge 200.

In one aspect, one or both of the openings 211, 212 can extend through the first body 210. In another aspect, the opening 211 can be configured to capture the hinge balls 231*a*, 231*b* within the first body 210, such that a portion of the hinge balls 231*a*, 231*b* protrude from the first body 210 in the secured position to facilitate engagement with the recesses 221*a*, 221*b* of the second body 220. Similarly, the opening 212 can be configured to capture the release balls 232*a*, 232*b* within the first body 210. This can prevent loose hardware when the first body 210 is separated from the second body 220. As illustrated, at least one of the openings 211, 212 of the first body 210 can be swaged to capture the hinge balls 231*a*, 231*b* and/or the release balls 232*a*, 232*b* within the respective openings 211, 212. By capturing the hinge balls 231*a*, 231*b*, the swaging of the hinge recesses 221*a*, 221*b* can also prevent the hinge balls 231*a*, 231*b* from escaping the hinge 200 via hinge recesses 221*a*, 221*b* in the second body 220, which may be configured as a through hole. Thus, all ball hardware can be captured by swaging the openings 211, 212 in the first body 210 of the hinge 200, trapping the balls in place. As a result, the hinge 200 can be configured such that there are no loose components whether the hinge 200 is separated or not. In one aspect, as illustrated in FIG. 5A, the hinge recess 221*a* can be configured as a blind hole that prevents the hinge ball 231*a* from escaping the second body 220, as well as the first body 210 when coupled, and maintains the hinge ball 231*a* in engagement with the hinge recess 221*a* in the secured position.

The releasable ball lock hinge 200 can also include an intermediate ball 233 disposed between the hinge balls 231*a*, 231*b* and the release balls 232*a*, 232*b*. The intermediate ball 233 can be configured to transfer forces between the hinge balls 231*a*, 231*b* and the release balls 232*a*, 232*b* to maintain the engagement of the hinge balls 231*a*, 231*b* and the second body 220, such as the hinge recesses 221*a*, 221*b*, in the secured position. In one aspect, in the secured position, the intermediate ball 233 can be in simultaneous contact with the hinge balls 231*a*, 231*b* and the release balls 232*a*, 232*b*. Thus, the portion 223 of the second body 220 can position the release balls 232*a*, 232*b*, which are in contact with the intermediate ball 233, such that the intermediate ball 233 contacts the hinge balls 231*a*, 231*b* and maintains the hinge balls 231*a*, 231*b* in engagement with the hinge recesses 221*a*, 221*b*.

Figure 5B:
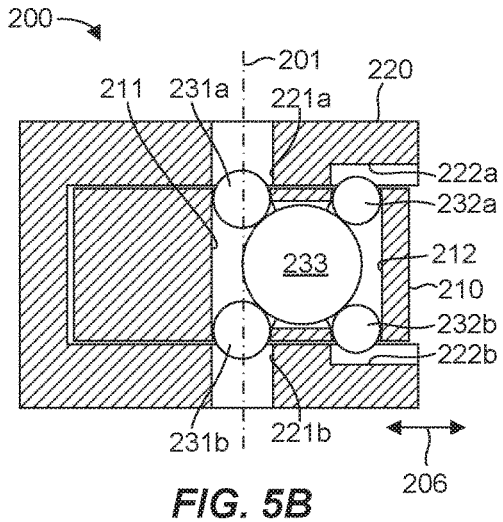
Figure 5C:
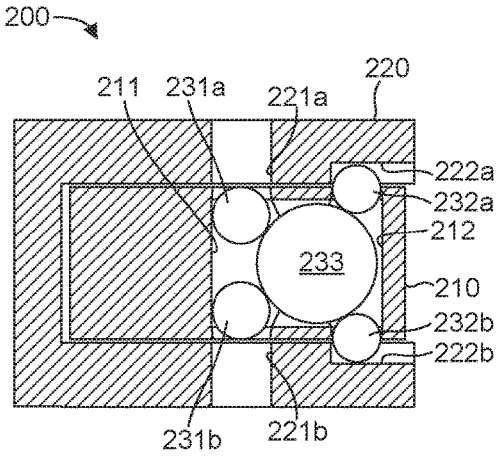
Figure 5D:
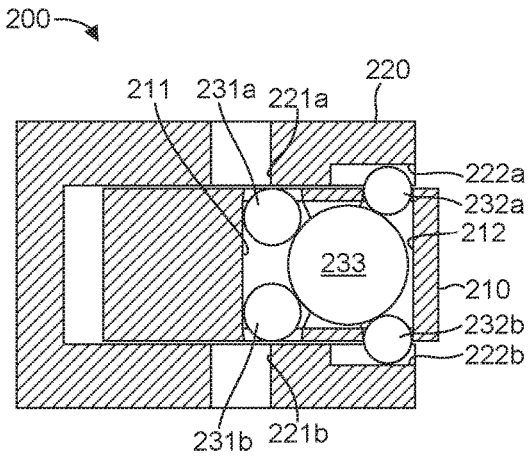
Figure 5E:
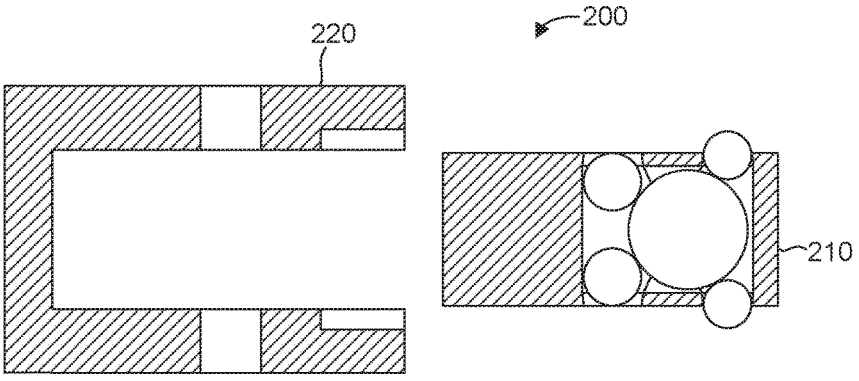

FIG. 5B illustrates the first body 210 and the second body 220 in the release position. The second body 220 can include release recesses 222*a*, 222*b* to receive the release balls 232*a*, 232*b* when the first body 210 and the second body 220 are in the release position. In one aspect, the intermediate ball 233 can be configured to move in a radial direction 206 relative to the axis of rotation 201 and the hinge balls 231*a*, 231*b* and the release balls 232*a*, 232*b* can be configured to move in the first body 210 with respect to the recesses 221*a*, 221*b*, 222*a*, 222*b*. In the release position, the release recesses 222*a*, 222*b* can facilitate movement of the release balls 232*a*, 232*b* into the release recesses 222*a*, 222*b*. Thus, upon rotation of the first body 210 relative to the second body 220 about the axis 201 to the release position, the intermediate ball 233 can facilitate movement of the hinge balls 231*a*, 231*b* out of engagement with the hinge recesses 221*a*, 221*b* of the second body 210, as shown in FIG. 5C. In one aspect, movement of the intermediate ball 233 in radial direction 206 can cause or facilitate movement of the hinge balls 231*a*, 231*b* and the release balls 232*a*, 232*b* in a direction parallel to the axis 201. In another aspect, such as when the first body 210 is acted on by a force tending to separate the first body 210 from the second body 220, the hinge recesses 221*a*, 221*b* can force the hinge balls 231*a*, 231*b* into the opening 211, which can force the intermediate ball 233 toward the opening 212 to force the release balls 232*a*, 232*b* into the release recesses 222*a*, 222*b*. The intermediate ball 233 can therefore be configured to displace the release balls 232*a*, 232*b*, as acted on by the hinge balls 231*a*, 231*b*. Thus, the release recesses 222*a*, 222*b* can facilitate movement of the hinge balls 231*a*, 231*b* out of engagement with the hinge recesses 221*a*, 221*b*, thereby facilitating separation of the first body 210 and the second body 220, as shown in FIGS. 5D and 5E. In particular, with the release balls 232*a*, 232*b* in the release openings 222*a*, 222*b* and the hinge balls 231*a*, 231*b* disengaged from the hinge recesses

221*a*, 221*b*, the first body 210 can move in direction 205 to separate the first body 210 from the second body 220. The hinge recesses 221*a*, 221*b* can extend to an outer surface of the second body 220 such that the release balls 231*a*, 231*b* can travel along the release recesses 222*a*, 222*b* to allow separation of the first and second bodies 210, 220.

Figure 6A:
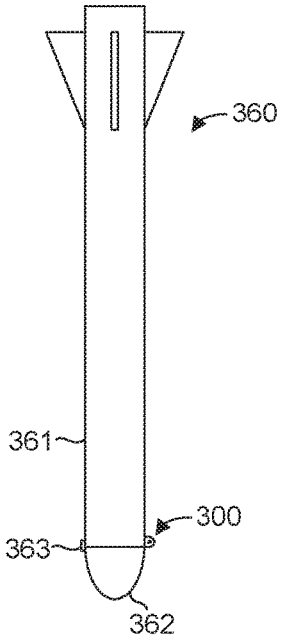
FIG. 6A-6D are example illustrations of a vehicle incorporating a releasable ball lock hinge to releasably secure an optics cover to a body of the vehicle, in accordance with an embodiment of the present invention.
Figure 6B:
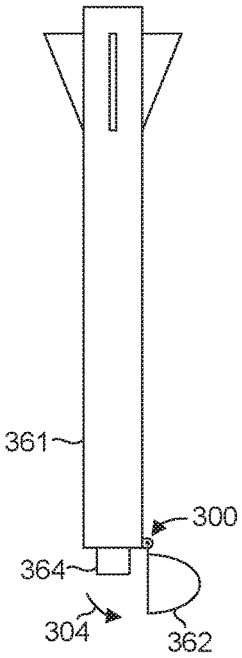

FIGS. 6A-6D illustrates a vehicle 360, such as a warhead or a missile, incorporating a releasable ball lock hinge 300 to releasably secure an optics cover 362 to a body 361 of the vehicle 360. The vehicle 360 can be any suitable vehicle, such as a kill vehicle or other missile system with disposable shielding for optical sensors. The releasable ball lock hinge 300 can include any feature of a releasable ball lock hinge disclosed herein to provide a simple but effective mechanism to ensure problem free cover ejection for such vehicles. As shown in FIG. 6A, the releasable ball lock hinge 300 can be used to secure the optics cover 362 to the vehicle body 361. A release mechanism 363 can be used to secure a free end of the cover 362 to the vehicle body 361 opposite the hinge 300. The release mechanism 363 can release the free end of the cover 362 to initiate ejection of the cover 362 from the vehicle body 361. The release mechanism 363 can include a pyrotechnic charge or other suitable means for releasing the cover 362.

Figure 6C:
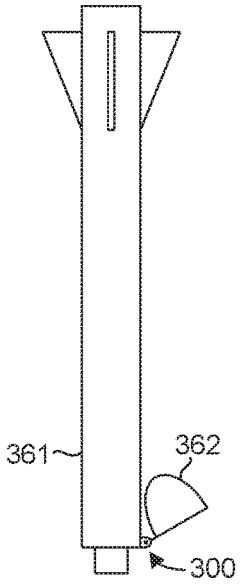
Figure 6D:
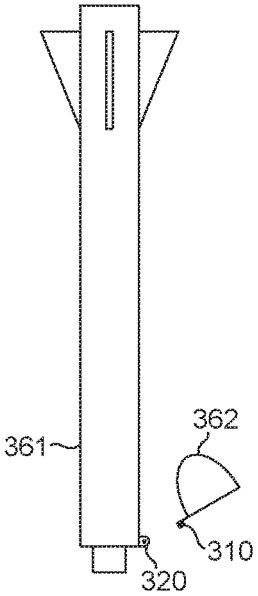

An adjustment mechanism of the hinge 300, as disclosed herein, can be used to effectively seal the optical cover 362 to the vehicle body 361. Upon release of the cover 362 by the release mechanism 363, the cover can rotate in direction 304 about the hinge 300 to expose optical sensor 364, as shown in FIG. 68. Rotation of the cover 362 can be caused by the pyrotechnic charge of the release mechanism 363 or by some other force, such as a spring associated with the release mechanism 363 or the hinge 300, and/or by stored mechanical energy released by a seal compressed between the cover 362 and the vehicle body 361. FIG. 6C illustrates the cover 362 rotated to the release position of the hinge 300. The angle of the release position can be selected to ensure that the cover 362 does not collide or interfere with the vehicle body 361 while also allowing rotation of up to greater than 180 degrees to facilitate separation of the cover 362 from the vehicle body 361 and to control the ejection path of the cover 362 away from the vehicle body 361, as shown in FIG. 6D. The releasable ball lock hinge 300 releases when the release balls align with and move into release recesses in the second body 320 of the hinge 300, thus allowing the hinge balls to move inward on the first body 310 of the hinge 300, releasing the hinge 300. At this point, with the centrifugal force of the cover 362 and, optionally, with a spring force, the first and second bodies 310, 320 are forced to separate, and the cover is ejected away from the main body 361.

In accordance with one embodiment of the present invention, a method for operating a releasable hinge is disclosed. The method can comprise aligning first and second hinge balls operable within a first opening of a first body with hinge recesses of a second body, wherein the first and second hinge balls are movable and engageable with the hinge recesses to provide an axis of rotation. The method can further comprise aligning first and second release balls operable within a second opening of the first body with release recesses of the second body, wherein the first and second release balls are movable and extend at least partially into the release recesses, thereby providing a release position. Additionally, the method can comprise moving the first body and the second body relative to one another about the axis of rotation to a secured position, wherein a portion of the second body is configured to position the release balls such that the hinge balls are maintained in engagement with the hinge recesses. It is noted that no specific order is required in this method, though generally in one embodiment, these method steps can be carried out sequentially.

In one aspect, the method can further comprise moving the first body and the second body relative to one another about the axis of rotation to the release position, wherein the release recesses facilitate movement of the release balls into the release recesses, and movement of the hinge balls out of engagement with the hinge recesses, thereby facilitating separation of the first body and the second body. In another aspect, the method can further comprise displacing an intermediate ball disposed between the hinge balls and the release balls.

Reference was made to the examples illustrated in the drawings and specific language was used herein to describe the same. It will nevertheless be understood that no limitation of the scope of the technology is thereby intended. Alterations and further modifications of the features illustrated herein and additional applications of the examples as illustrated herein are to be considered within the scope of the description.

Furthermore, the described features, structures, or characteristics may be combined in any suitable manner in one or more examples. In the preceding description, numerous specific details were provided, such as examples of various configurations to provide a thorough understanding of examples of the described technology. It will be recognized, however, that the technology may be practiced without one or more of the specific details, or with other methods, components, devices, etc. In other instances, well-known structures or operations are not shown or described in detail to avoid obscuring aspects of the technology.

Although the subject matter has been described in language specific to structural features and/or operations, it is to be understood that the subject matter defined in the appended claims is not necessarily limited to the specific features and operations described above. Rather, the specific features and acts described above are disclosed as example forms of implementing the claims. Numerous modifications and alternative arrangements may be devised without departing from the spirit and scope of the described technology.

What is claimed is:

1. A releasable ball lock hinge, comprising:

a first body having first and second openings;

first and second hinge balls configured to move within the first opening;

first and second release balls configured to move within the second opening;

a second body configured to rotatably interface and removably couple with the first body, the second body having hinge recesses to engage the first and second hinge balls when the first body and the second body are in a secured position, thereby providing an axis of rotation for the hinge, and release recesses to receive the first and second release balls when the first body and the second body are in a release position; and an intermediate ball disposed between the hinge balls and the release balls, wherein, in the secured position, a portion of the second body is configured to position the release balls such that the hinge balls are maintained in engagement with the hinge recesses, wherein, in the release position, the release recesses facilitate movement of the release balls into the release recesses, and movement of the hinge balls out of engagement with the hinge recesses, thereby facilitating separation of the first body and the second body, and wherein the intermediate ball is configured to transfer forces between the hinge balls and the release balls to maintain the engagement of the hinge balls and the hinge recesses in the secured position, and to facilitate movement of the hinge balls out of engagement with the hinge recesses in the release position.

2. The releasable ball lock hinge of claim 1, wherein, in the secured position, the intermediate ball is in simultaneous contact with the hinge balls and the release balls.

3. The releasable ball lock hinge of claim 1, wherein, in the release position, the intermediate ball is configured to displace the release balls into the release recesses as acted on by the hinge balls.

4. The releasable ball lock hinge of claim 1, wherein the first body is configured to capture the first and second hinge balls and the first and second release balls.

5. The releasable ball lock hinge of claim 1, wherein at least one of the first and second openings of the first body are configured to capture the respective balls in the first body.

6. The releasable ball lock hinge of claim 5, wherein at least one of the first and second openings of the first body are swaged.

7. The releasable ball lock hinge of claim 1, wherein the first opening extends through the first body and is configured to capture the first and second hinge balls, and wherein a portion of the hinge balls protrude from the first body in the secured position.

8. The releasable ball lock hinge of claim 1, wherein the second opening extends through the first body and is configured to capture the first and second release balls, and wherein a portion of the release balls protrude from the first body in the release position.

9. The releasable ball lock hinge of claim 1, wherein the first body and the second body are rotatable to align the first and second release balls with the release recesses.

10. The releasable ball lock hinge of claim 1, wherein the first body and the second body are rotatable to facilitate contact between the release balls and the portion of the second body to maintain engagement of the hinge balls and the hinge recesses in the secured position.

* * * * *